US008646321B2

(12) United States Patent
Ueno

(10) Patent No.: US 8,646,321 B2
(45) Date of Patent: Feb. 11, 2014

(54) TEST SYSTEM AND TEST METHOD OF FLUID PUMP

(71) Applicant: Denso Corporation, Kariya (JP)

(72) Inventor: Yoshitomo Ueno, Chita-district (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 13/668,700

(22) Filed: Nov. 5, 2012

(65) Prior Publication Data

US 2013/0133410 A1 May 30, 2013

(30) Foreign Application Priority Data

Nov. 25, 2011 (JP) ..... 2011-257073

(51) Int. Cl.
*G01M 15/09* (2006.01)

(52) U.S. Cl.
USPC ..... 73/114.41

(58) Field of Classification Search
USPC ..... 73/114.41
See application file for complete search history.

(56) References Cited

U.S. PATENT DOCUMENTS 4,122,707 A * 10/1978 Leunig ..... 73/114.44
4,387,589 A * 6/1983 Larson ..... 73/116.04
4,437,341 A * 3/1984 Ito et al. ..... 73/114.48
4,488,429 A * 12/1984 Ito ..... 73/114.47
4,546,648 A * 10/1985 Abt et al. ..... 73/114.48
4,798,084 A 1/1989 Takahashi et al.
5,731,515 A * 3/1998 Tominaga et al. ..... 73/114.41
6,755,076 B1 * 6/2004 Schmidt et al. ..... 73/114.47
7,197,918 B2 * 4/2007 Shen ..... 73/114.51
7,878,052 B2 * 2/2011 Danby et al. ..... 73/114.49
8,220,321 B2 * 7/2012 Koivunen ..... 73/114.41
2013/0174655 A1 * 7/2013 Schoenfeld et al. ..... 73/114.41

FOREIGN PATENT DOCUMENTS

JP A-62-188912 8/1987
JP A-2004-19547 1/2004

* cited by examiner

*Primary Examiner* — Freddie Kirkland, III
(74) *Attorney, Agent, or Firm* — Oliff PLC

(57) ABSTRACT

A test system of a fluid pump which has a pump includes a test fixture which supports the fluid pump, a fluid flow path, and a connecting pipe arranged at the test fixture and having one end side connected to a discharge port of the pump and the other end side connected to the fluid flow path. The connecting pipe has a main pipe member, a movable pipe member arranged slidably inside the main pipe member and having an end which is positioned sticking out from the main pipe member, and a seal clamp provided at an end of the movable pipe member. When the movable pipe member receives fluid pressure inside of the main pipe member, the seal clamp which is pushed against the discharge port of the pump holds the discharge port of the pump liquid-tightly.

7 Claims, 7 Drawing Sheets

TEST SYSTEM AND TEST METHOD OF FLUID PUMP

BACKGROUND OF THE INVENTION

1. Field of the Invention

The present invention relates to a test system and test method of a fuel pump which is to be mounted in a vehicle or other fluid pump.

2. Description of the Related Art

The final product tests of fuel pumps which feed fuel to vehicular internal combustion engines include performance tests which measure the pump flow rate performance and also vibration tests which measure the vibration at the time of pump operation. Of these, tests of pump performance are described in, for example, Japanese Patent Publication No. 62-188912 A1 and Japanese Patent Publication No. 2004-19547 A1. The measuring device in Japanese Patent Publication No. 62-188912 A1 measures the amount of fuel injection from a fuel injector which is directly connected to a fuel injection pump. It connects the fuel injector to a diaphragm type fuel volume detector and enables measurement of the actual fuel injection amount with a good response from the amount of change in volume at the time of fuel injection and the detected amount of discharged fuel.

Further, Japanese Patent Publication No. 2004-19547 A1 discloses a test system which arranges a test fluid tank at a fuel inlet side of a fuel pump, attaches a tank cover to a fuel outlet side, seals the space between the fuel output and tank cover with a seal member, and operates the fuel pump to run tests in that state. The fuel outlet is connected to a measuring part which is provided with a measurement passage for the discharged fluid.

On the other hand, vibration tests are run to investigate for problems in the manufacture or assembly of component parts by vibration of the fuel pump. These tests differ in the discharge pressures in the measurement conditions, so usually separate measurement units are used to run tests by separate processes.

SUMMARY OF THE INVENTION

To simplify the test process, combining the plurality of test facilities is promising. However, securing test reliability requires as a precondition that the pump discharge port be held by a suitable seal clamp force. For example, in vibration tests, it is necessary to accurately measure the trends in vibration without causing attenuation of the vibration produced. For this reason, the seal clamp force cannot be either too large or too small. As opposed to this, in performance tests, a seal clamp force which is able to withstand a further larger discharge pressure is sought.

In this way, performance tests and vibration tests differ in the two clamp conditions, so it is necessary to use systems enabling settings giving the optimal clamp structures. Therefore, the present invention has as its object to realize a test system and test method of a fluid pump which use a single system to enable both clamp conditions to be satisfied and which run these tests by a series of processes so as to be able to shorten the test process and streamline the facilities and thereby reduce costs.

According to a first aspect of the present invention, there is provided a test system of a fluid pump which has a pump having a suction port and a discharge port of a fluid and a drive unit for driving the pump. The test system comprises a test fixture which supports the fluid pump, a fluid flow path which is provided with a discharge pressure adjusting means, and a connecting pipe arranged at the test fixture and having one end side connected to the discharge port of the pump and the other end side connected to the fluid flow path.

The connecting pipe has a main pipe member which includes the other end side, a movable pipe member arranged slidably inside the main pipe member and having an end which is positioned sticking out from the main pipe member and forms the one end side, and a seal clamp provided at the end of the movable pipe member. When the movable pipe member receives fluid pressure inside of the main pipe member, the seal clamp which is pushed against the discharge port of the pump holds the discharge port of the pump liquid-tightly.

In a second aspect of the present invention, the seal clamp preferably comprises elastic seal member which is interposed between the movable pipe member and the discharge port.

In a third aspect of the present invention, preferably the main pipe member has a pipe end which is connected to the fluid flow path, the flow diameter of the pipe end is smaller than the diameter of the space inside the main pipe member in which the movable pipe member can slide, and a spring member which biases the movable pipe member in the direction of the discharge port is arranged in the space inside of the main pipe member.

In a fourth aspect of the present invention, preferably the test fixture comprises a supporting base member which supports the connecting pipe and elastically supports the end of the fluid pump at the suction port side inside of a test fluid tank.

In a fifth aspect of the present invention, preferably the fluid pump is provided with a terminal for feed of electric power to the drive unit and the test fixture is provided with conducting means for connecting the terminal to an external power supply.

In a sixth aspect of the present invention, preferably the test fixture is provided with a holding member which holds the connecting pipe and conducting means to be able to advance and retract in the direction of connection to the discharge port and terminal.

In a seventh aspect of the present invention, there is provided a test method of a fluid pump which uses the test system of the first aspect, wherein the test system further comprises a flow rate detecting means which is arranged in the fluid flow path which is provided with the discharge pressure adjusting means. The test method includes a step of attaching a vibration detecting means to an outside wall of the fluid pump, a first test process of using the discharge pressure adjusting means to adjust the first discharge pressure and using the vibration detecting means to run a vibration test of the fluid pump, and a second test process of using the discharge pressure adjusting means to adjust to a second discharge pressure which is higher than the first discharge pressure and uses the flow rate detecting means to run a performance test of the fluid pump.

The test system according to the first aspect of the present invention configures the connecting pipe which connects to the discharge port of the fluid pump from a movable pipe member at which the seal clamp is provided and a main pipe member. The fluid pressure inside of the main pipe member is made to act against the movable pipe member and the seal clamp which is provided at the end pushes against the discharge port for sealing. This seal clamp force changes in accordance with the discharge pressure. Under conditions of a small discharge pressure, the seal clamp force can be reduced, while under conditions of a large discharge pressure, the seal clamp force can be enlarged.

Therefore, it is possible to utilize the possessed discharge pressure to freely change the seal clamp force in accordance with the discharge pressure, so it is possible to use the discharge pressure adjusting means to adjust the discharge pressure and thereby perform a plurality of tests of different discharge pressure conditions, for example, a vibration test and a performance test, by a single test system. Accordingly, it is possible to realize a test system of a fluid pump which is excellent in reliability and can reduce costs by streamlining the test process and facility.

In the second aspect of the present invention, by providing the end of the seal clamp with an elastically deformable seal member, it is possible to reliably hold the clamp liquid tightly and by making the pushing force of the elastic seal member variable in accordance with change of the discharge pressure, it is possible to cause a suitable seal clamp force to act.

In the third aspect of the present invention, the outlet port from the inside of the main pipe member to the fluid flow path is configured such that the fluid is restricted and resistance is received. The resistance force of the fluid and the spring force are used to push the movable pipe member against the discharge port, whereby a seal clamp force in accordance with the discharge pressure can be easily exhibited.

In the fourth aspect of the present invention, a supporting base member is provided which supports the fluid pump at the discharge port side and the suction port side. The discharge port side is supported by the seal clamp by a suitable seal clamp force, while the suction port side which is housed at the test fluid tank is elastically supported, so good tests can be conducted without obstructing vibration measurement etc.

In the fifth aspect of the present invention, the test fixture is provided with a conducting means and electric power can be fed to the drive unit through a fluid pump terminal to drive rotation of the pump.

In the sixth aspect of the present invention, the holding means of the seal clamp and the conducting means is made movable and the fluid pump is attached to the test fixture in the state made a position where these members are retracted from the discharge port and terminal of the fluid pump. Next, along with the holding means, the seal clamp and conducting means are advanced. This enables easy connection of the discharge port and terminal and enables the test process to be efficiently performed.

According to a test method of a fluid pump of a seventh aspect of the present invention, after starting the operation of the fluid pump, first the pressure is made to rise to a first discharge pressure and a first test process constituted by a vibration test of the fluid pump is run by a vibration detecting means. At this time, the seal clamp of the test fixture is pushed against the discharge port by a relatively low seal clamp force which corresponds to the discharge pressure, so measurement is performed with a good accuracy without obstructing the generation of vibration. Next, the pressure is made to rise to a higher second discharge pressure and a second test process constituted by a performance test of the fluid pump is run by a flow rate detecting means. At this time, the seal clamp of the test fixture is pushed against the discharge port by a relatively high seal clamp force which corresponds to the discharge pressure, so even if the discharge pressure rises, the seal clamp is reliably pushed and held and good precision measurement is performed.

The present invention may be more fully understood from the description of preferred embodiments of the invention, as set forth below, together with the accompanying drawings.

DESCRIPTION OF PREFERRED EMBODIMENTS

Figure 1:
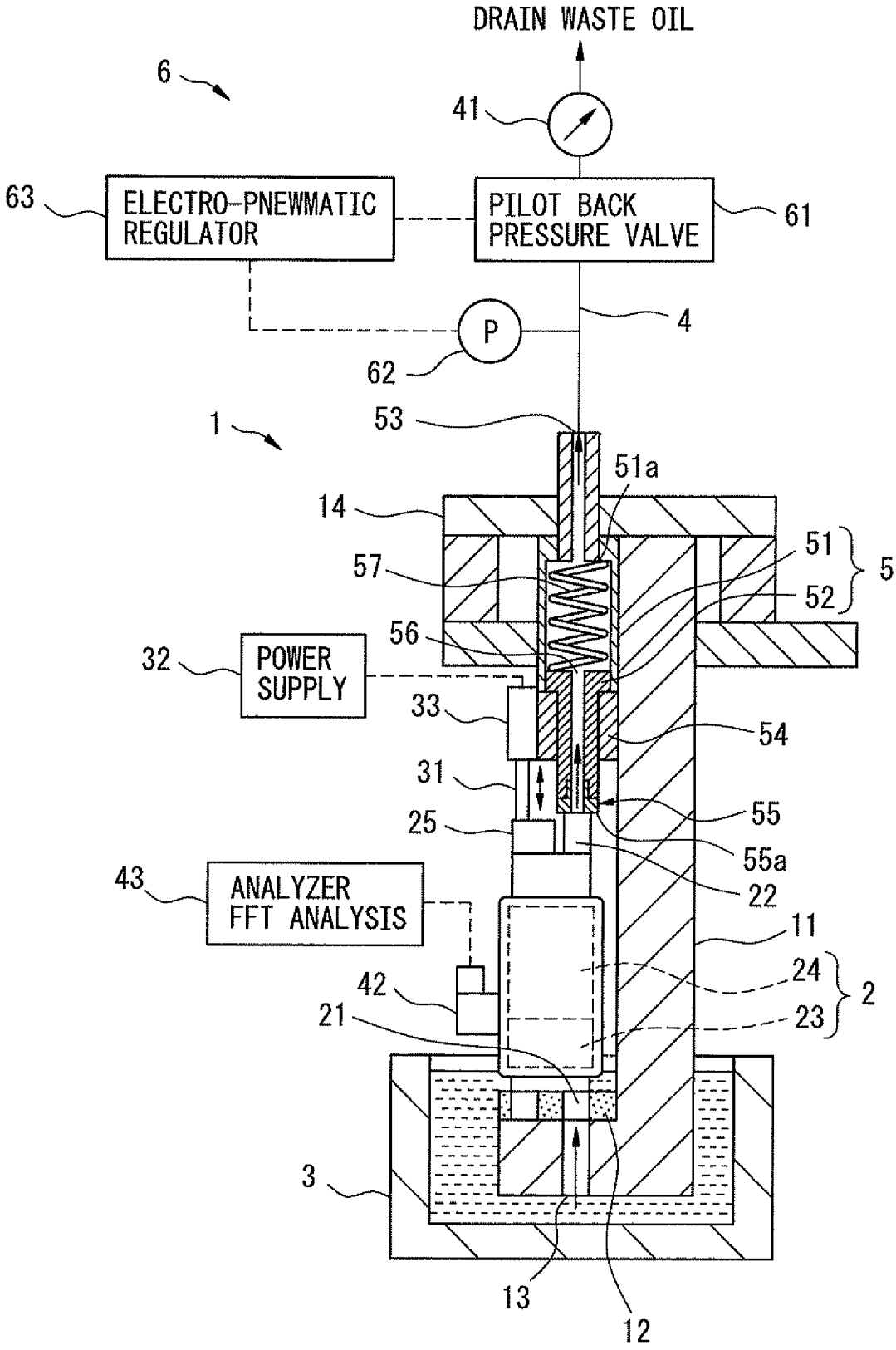
FIG. 1 is a schematic system diagram which shows an overall configuration of a test system of a fluid pump according to a first embodiment of the present invention.
Figure 2:
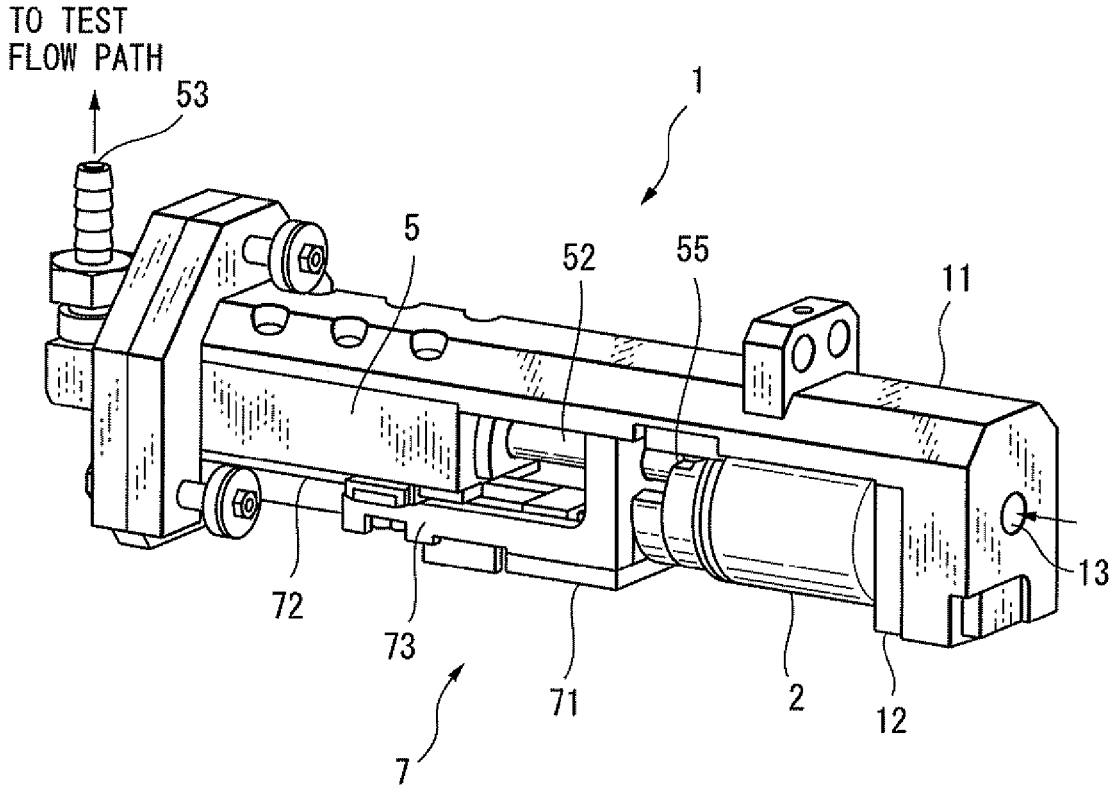
FIG. 2 is a perspective view of a test fixture which constitutes the main part of the test system.
Figure 3:
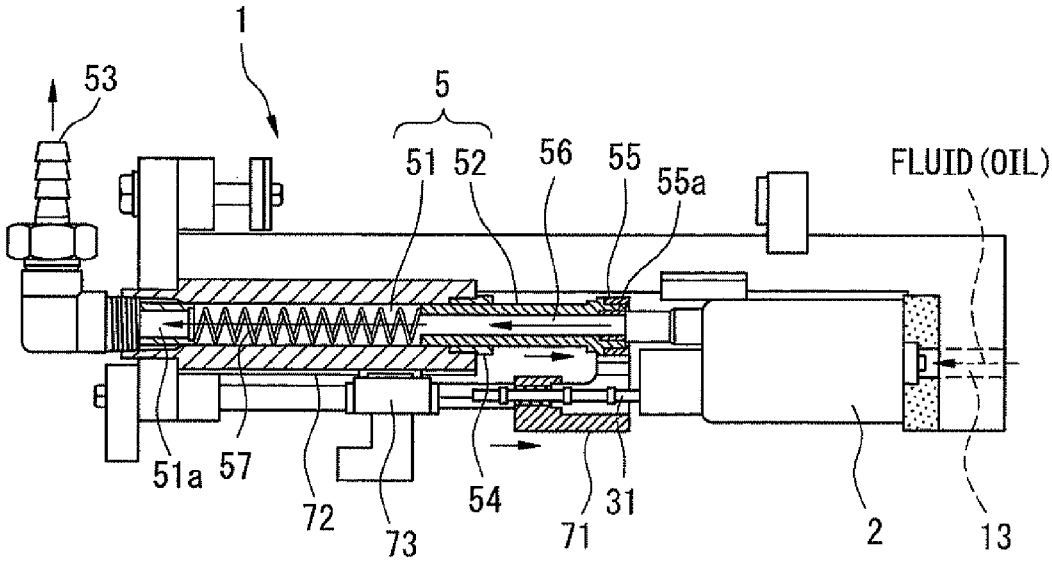
FIG. 3 is a side view of the test fixture.
Figure 4:
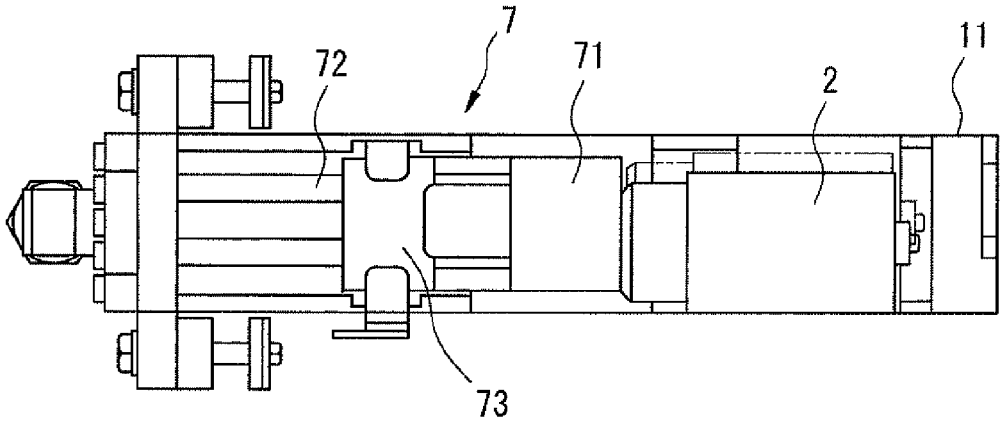
FIG. 4 is a front view of the test fixture.

Below, embodiments which utilize the present invention will be explained in detail based on the drawings. FIG. 1 is a schematic system diagram which shows an overall configuration of a test system of a fluid pump according to a first embodiment of the present invention. FIG. 2 is a perspective view of a test fixture 1 which constitutes the main part of the test system, while FIG. 3 and FIG. 4 show the detailed configuration of the same. The test system of the present invention is suitable for final product tests of fluid pumps which are used in various types of fields. Here, it will be explained by the example of application to a fuel pump 2 for use in a vehicle internal combustion engine.

In FIG. 1, the test system has a test fixture 1 to which a fuel pump 2 is to be attached, a test oil tank 3 as a test fluid tank which feeds a test fluid to the fuel pump 2, and a test flow path 4 as a fluid flow path through which test oil which is discharged from the fuel pump 2 flows. The fuel pump 2 and the test flow path 4 are connected through a connecting pipe 5 which is provided at the test fixture 1. At the test flow path 4, a discharge pressure adjusting means constituted by a discharge pressure adjustment part 6 and a flowmeter 41 for performance test use are arranged. Further, at the outer side wall of the fuel pump 2, a vibration sensor 42 is provided for vibration test use.

The test fixture 1 is provided with a substantially L-shaped supporting base member 11. On the horizontal surface of the L-shape which is arranged inside the test oil tank 3, the fuel pump 2 is elastically supported through a cushion member 12. Right above the fuel pump 2, the connecting pipe 5 is arranged with the vertical direction in the figure as its axial direction. The vertical wall of the L-shape of the supporting base member 11 extends upward along the side surface of the fuel pump 2 and supports the side part of the connecting pipe 5.

The fuel pump 2 has a suction port 21 which sticks out and opens from the pump bottom surface and a discharge port 22 which sticks out and opens from the pump top surface. A built-in pump 23 is driven to rotate by a drive unit constituted by a motor 24. The pump 23 is a known configuration which has a not shown impeller. It is designed to pump up fuel along with rotation of the impeller by the motor 24 and to discharge it from the discharge port 22 to the connecting pipe 5. On the top surface of the pump, a terminal 25 is provided for feeding electric power to the motor 24.

The test oil tank 3 is filled with test oil of properties equivalent to fuel and is housed so that a bottom surface side including the suction port 21 of the fuel pump 2 which is supported by the test fixture 1 is immersed in it. The test fixture 1, as shown in FIG. 2, is provided with a feed port 13 of test oil which passes through the bottom surface of the supporting base member 11 and feeds test oil to the suction port 21 of the fuel pump 2. Further, at the top end of the supporting base member 11, a flange-shaped support 14 is provided so as to surround the outer circumference of the top end of the connecting pipe 5. An outlet port 53 is positioned sticking out above that.

In FIG. 1, the connecting pipe 5 is the characteristic part of the present invention. It is connected to the discharge port 22 of the fuel pump 2 at one end side (bottom end side of figure). The other end side (top end side of figure) is connected to the test flow path 4. The connecting pipe 5 has a main pipe member 51 and a movable pipe member 52 which is arranged slidably inside the main pipe member 51. The movable pipe member 52 here is formed in a piston shape. The piston-shaped movable pipe member 52 has a large diameter top end which slides against the inside walls of the main pipe member 51. A small diameter rod part which extends downward is slidably supported by a bearing 54 which is provided at a bottom end side of the main pipe member 51.

One end (bottom end of figure) of the movable pipe member 52 which is positioned sticking out downward from the bearing 54 forms a seal clamp 55 which pushes against and holds the discharge port 22 of the fuel pump 2 through a tubular elastic seal member 55*a* which is provided at its front end and is comprised of an elastic material. Inside of the movable pipe member 52, a discharge flow path 56 is formed which passes through the large diameter top end and small diameter rod part. The discharge flow path 56 communicates the discharge port 22 with the space inside of the main pipe member 51 which houses the large diameter top end of the movable pipe member 52. The main pipe member 51 is set with an inside diameter of the pipe end 51*a*, which reaches the outlet port 53 at the top end, smaller than the inside diameter of the space inside of the main pipe member 51. The test fluid of the space inside of the main pipe member 51 is restricted by the pipe end and receives resistance, whereby the test oil pressure acts in a direction which pushes the movable pipe member 52 against the discharge port 22. Further, at the space inside of the main pipe member 51, a spring member 57 is arranged to bias the movable pipe member 52 in the discharge port 22 direction (downward in figure) and make the seal clamp 55 constantly push against the discharge port 22.

At this time, the movable pipe member 52 can slide inside of the main pipe member 51. The force by which the seal clamp 55 holds the discharge port 22 can be made variable in accordance with the test oil pressure of the space inside of the main pipe member 51. That is, it is possible to adjust the discharge pressure from the fuel pump 2 so as to change the seal clamp force of the discharge port 22 by the seal clamp 55. The more the test oil pressure of the space inside of the main pipe member 51 rises, the more the force which pushes the movable pipe member 52 against the discharge port 22 increases. Note that, the configuration of the seal clamp 55 of FIG. 1 is shown schematically. A detailed example of the configuration will be explained later. Further, the spring member 57 is arranged so as to aid the movable pipe member 52 to move in accordance with need, so is set to a relatively small biasing force and sometimes can even be omitted.

At the side of the movable pipe member 52, a conducting probe 31 is arranged in parallel to the vertical direction of the figure as a conducting means. The conducting probe 31 is connected to the terminal 25 of the fuel pump 2 and can electrify the motor 24 of the fuel pump 2 from the power supply 32 which is provided at the outside. Here, the conducting probe 31 is held at a support member 33 which is provided integrally with the bearing 54 which supports the movable pipe member 52.

Due to this, it becomes possible to apply voltage to the motor 24 of the fuel pump 2 to drive rotation of the pump 23 and to discharge test oil to the test flow path 4 through the outlet port 53 of the connecting pipe 5. The test flow path 4 is provided with a discharge pressure adjustment part 6 comprised of a pilot back pressure valve 61 and pressure gauge 62 and an electro-pneumatic regulator 63. The pilot back pressure valve 61 is a pilot type back pressure valve which utilizes the discharge oil pressure for operation of the valve element. By using the detected value of the pressure gauge 62 as the basis for the electro-pneumatic regulator 63 to control the pilot back pressure valve 61, the desired discharge pressure can be adjusted to. Further, the discharge flow rate of the fuel pump 2 changes depending on the pump speed, so it is preferable to adjust the voltage which is applied to the motor 24 in accordance with the discharge pressure conditions of the individual tests.

The test flow path 4 has a flowmeter 41 attached to it as a flow rate detecting means for a performance test. Therefore, by measuring the flow rate of the test oil at a predetermined discharge pressure, it is possible to test the discharge flow rate performance of the fuel pump 2. The test flow path 4 is connected to a drain flow path for discharge of the test oil after a test.

The outside wall of the fuel pump 2 is provided with a vibration detecting means for a vibration test constituted by a vibration sensor 42. As the vibration sensor 42, for example, an acceleration sensor etc. can be used. By outputting the detection results to an analyzer 43 and performing FFT vibration analysis, it is possible to inspect for problems arising due to the manufacture, assembly, etc. of the parts forming the fuel pump 2.

Here, when performing a plurality of tests with different measurement conditions, in particular, discharge pressure, at the time of final product test, it is demanded that a suitable seal clamp force which corresponds to the discharge pressure be used to hold the discharge port 22 of the fuel pump 2. That is, at the time of a vibration test, in order not to suppress vibration, a seal clamp force of an extent which does not overly push against the discharge port 22 and can prevent oil leakage is required. On the other hand, at the time of flow rate measurement, the discharge port 22 has to be held reliably by a larger seal clamp force. Further, at the time of a vibration test, to measure the vibration generated with a good precision, a support structure which does not restrict vibration of the fuel pump 2 body is demanded.

Therefore, in the present invention, the supporting base member 11 of the test fixture which is shown in FIGS. 1 and 2 is used to elastically support the bottom surface of the fuel pump 2, a clearance is provided between the side surface of the fuel pump 2 and the supporting base member 11, and the seal clamp force of the seal clamp 55 which holds the discharge port 22 of the top part of the fuel pump 2 is made variable. The connecting pipe 5 at which the seal clamp 55 is provided is stably supported by the vertical wall of the supporting base member 11 and the flange-shaped support 14 at the top end of the same, so a vibration test of the fuel pump 2 body is not obstructed.

FIG. 3 and FIG. 4 show an example of the detailed structure of the connecting pipe 5 which includes the seal clamp 55. Here, the connecting pipe 5 has a main pipe member 51 which is supported by a flange-shaped support 14 and a rod-shaped movable pipe member 52 which is inserted slidably inside the right end opening of the main pipe member 51. Inside the right end opening of the main pipe member 51, a bearing 54 which enables the movable pipe member 52 to slide is attached through a seal member. Further, at the left end opening of the main pipe member 51, a pipe member continuing from the outlet port 53 is attached. A spring member 57 is housed between pipe end with a smaller diameter than the main pipe member 51 and the movable pipe member 52. In this way, the shape of the movable pipe member 52 can be freely changed to a piston shape, movable rod shape, etc.

The seal clamp 55 is configured by making the front end of the movable pipe member 52 (right end of the figure) somewhat thinner and attaching a tubular elastic seal member 55*a* to the front end opening. The elastic seal member 55*a* is, for example, comprised of a urethane-based elastic seal material. A flange which is provided at one end side of the seal member 55*a* covers the front end face of the movable pipe member 52, while a tubular part at the other end side is inserted into the movable pipe member 52 Therefore, when the seal clamp 55 abuts against the discharge port 22 of the fuel pump 2, the elastic seal member 55*a* covers the surroundings of the discharge port 22 to provide a liquid-tight seal.

This sealing force is generated by the movable pipe member 52 being pushed in the discharge port 22 direction by the resistance force which is received by the fluid which is restricted by the pipe end of the main pipe member 51 and the biasing force of the spring member 57 and changes depending on the pressure of the test oil of the space inside the main pipe member 51. That is, when the discharge pressure is relatively small, the force which acts on the movable pipe member 52 is also small. If the discharge pressure rises, the force which acts on the movable pipe member 52 increases and it slides in a direction by which the seal clamp 55 is pushed against the discharge port 22, so the seal clamp force increases. At this time, the force which acts on the movable pipe member 52 is proportional to the area of the ring-shaped end face of the movable pipe member 52 (pressure receiving surface area S1) which faces the space inside of the main pipe member 51. However, the end face at the front end side of the seal clamp 55 (pressure receiving surface area S2) is acted on in the reverse direction by the pressure of the test oil in the space inside of the main pipe member 51, so it is possible to obtain the desired sealing force by making this reverse direction pressure receiving surface area S2 smaller than the pressure receiving surface area S1 and suitably setting the inside/outside diameters of the movable pipe member 52 which defines the pressure receiving surface area S1.

In this way, in the test system of the present invention, the seal clamp 55 of the test fixture 1 can seal itself in accordance with the measurement conditions and thereby handle a plurality of test which differ in the discharge pressure conditions and shorten the test process. At this time, before the start of the tests, the fuel pump 2 has to be set at the test fixture 1 and connection work of the conducting probe 31 has to be performed, so with the test fixture 1 which is shown in FIGS. 2 and 3, an elevating part 7 which can raise and lower the seal clamp 55 and the conducting probe 31 integrally is provided so as to improve the workability at the time of attachment and detachment of the pump.

The elevating part 7 is provided with a holding member 71 which temporarily holds the outer circumferences of the seal clamp 55 and the conducting probe 31 together, a rail member 72 which is fastened to the flange 14 at the top end of the supporting base member 11, and a slide member 73 which can be raised or lowered while being guided by the rail member 72. The rail member 72 extends in the vertical direction along the side surface of the connecting pipe 5. The slide member 73, which is provided above the holding member 71 integrally with the same, is raised and lowered while being guided by the rail member 72. Along with this, the holding member 71 which holds the seal clamp 55 and the conducting probe 31 can advance and retract in the connection direction of the feed port 21 of the fuel pump 2 and the terminal 25. Preferably, the outer circumference of the conducting probe 31 and the holding member 71 have an elastic material interposed and elastically held between them so as to enable connection with the terminal 25 to be secured without obstructing the vibration test of the fuel pump 2.

Figure 5:
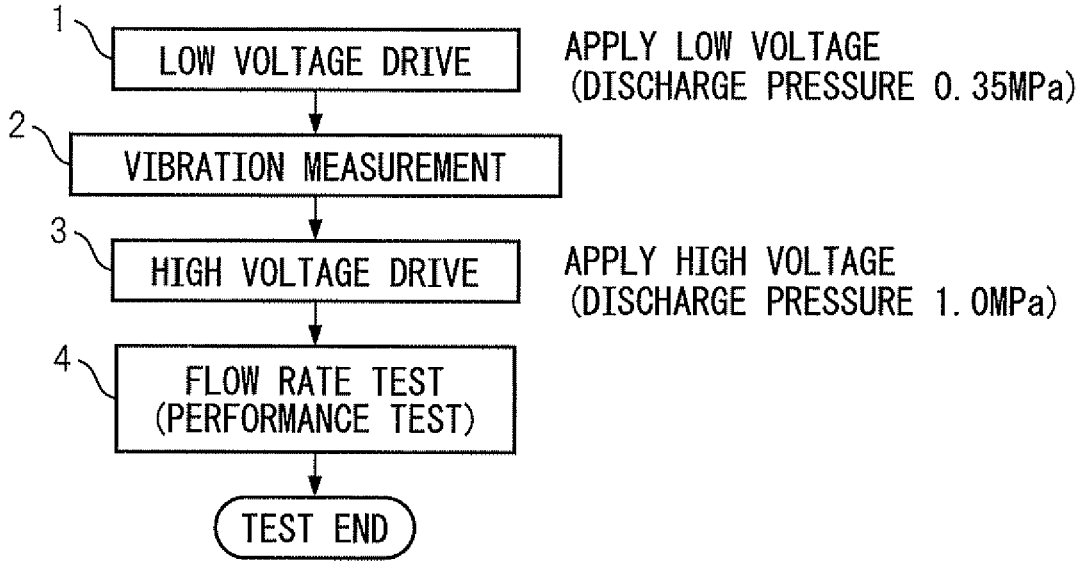
FIG. 5 is a process diagram for explaining a test method which uses a test system of a fluid pump according to the present invention.
Figure 6:
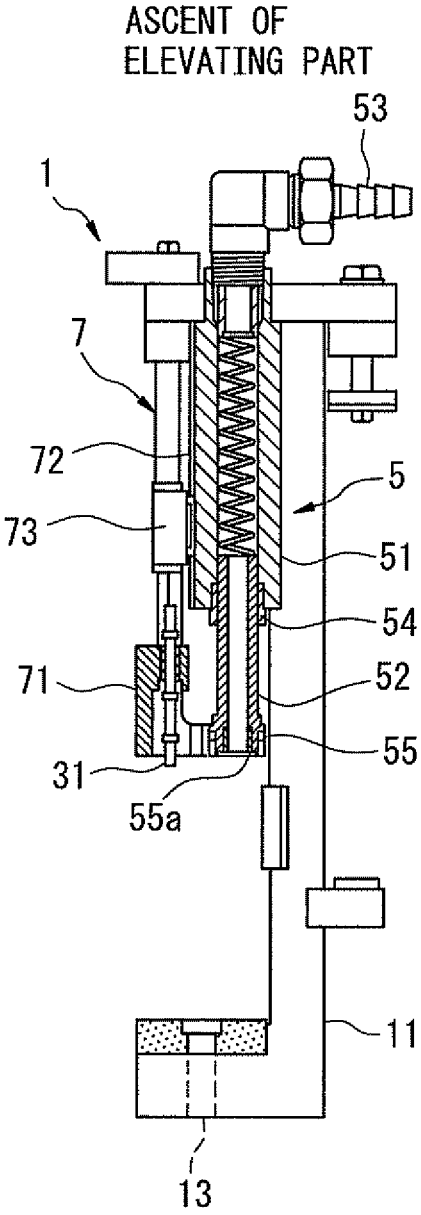
FIG. 6 is a side view of the test fixture for explaining a procedure for attaching a fuel pump to a test system of a fluid pump according to the present invention in a test process which uses the test system.
Figure 7:
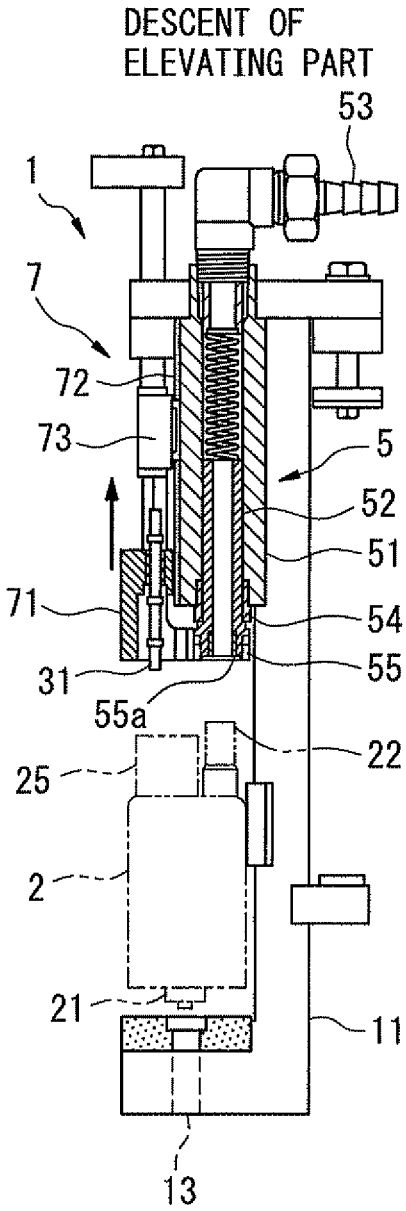
FIG. 7 is a side view of the test fixture for explaining a procedure for attaching a fuel pump to a test system of a fluid pump according to the present invention in a test process which uses the test system.

Next, the test method in the case of using a test system of the above configuration to perform a vibration test and performance test of the fuel pump 2 will be explained with reference to FIG. 5 to FIG. 10. FIG. 5 is a flow chart which shows a series of test steps. Before these steps, first, the fuel pump 9 is set at the test fixture 1 as shown in FIG. 6 to FIG. 9. The step (1) which is shown in FIG. 6 and the step (2) which is shown in FIG. 7 show the state of sliding the slide member 73 of the elevating part 7 upward along the rail member 72 in the state where the product is not set at the text fixture 1. Due to this, along with the holding member 71, which is integral with the slide member 73, the seal clamp 55 and conducting probe 31 are lifted up and a sufficient space is formed for attachment of the fuel pump 2 (broken line in the figure). At this time, the movable pipe member 52 connected to the seal clamp 55 follows the holding member 71 and rises inside the main pipe member 51.

Figure 8:
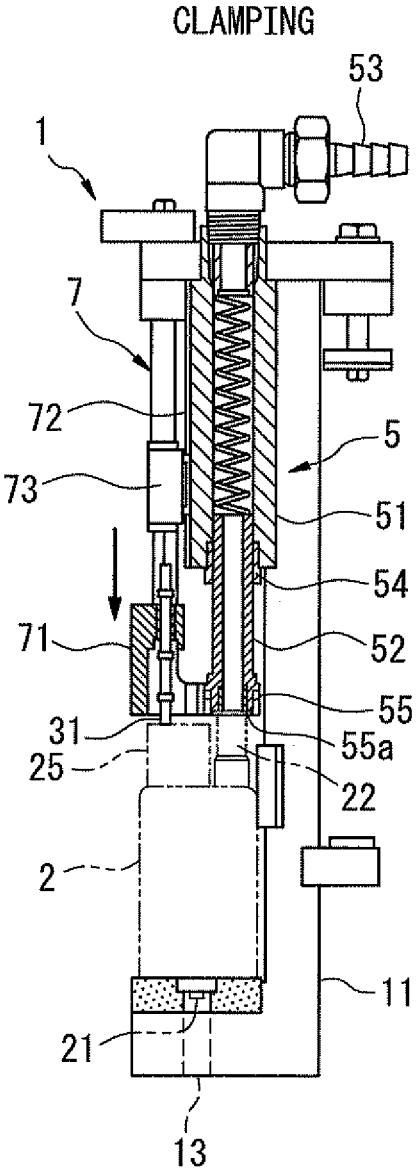
FIG. 8 is a side view of the test fixture for explaining a test procedure of a fuel pump which is attached to a test system of a fluid pump according to the present invention in a test process which uses the test system.

After the fuel pump 2 is set at a predetermined position, as shown by the step (3) which is shown in FIG. 8, the slide member 73 and the holding member 71 of the elevating part 7 are moved downward whereby the seal clamp 55 which is held by the holding member 71 is attached to the discharge port 22 of the fuel pump 2. At the same time, the conducting probe 3 which is held by the holding member 71 is electrically connected to the terminal 25. By providing the elevating part 7 at the test fixture 1 in this way, setting the fuel pump 2 becomes easy and the work preceding the test can be streamlined.

Figure 9:
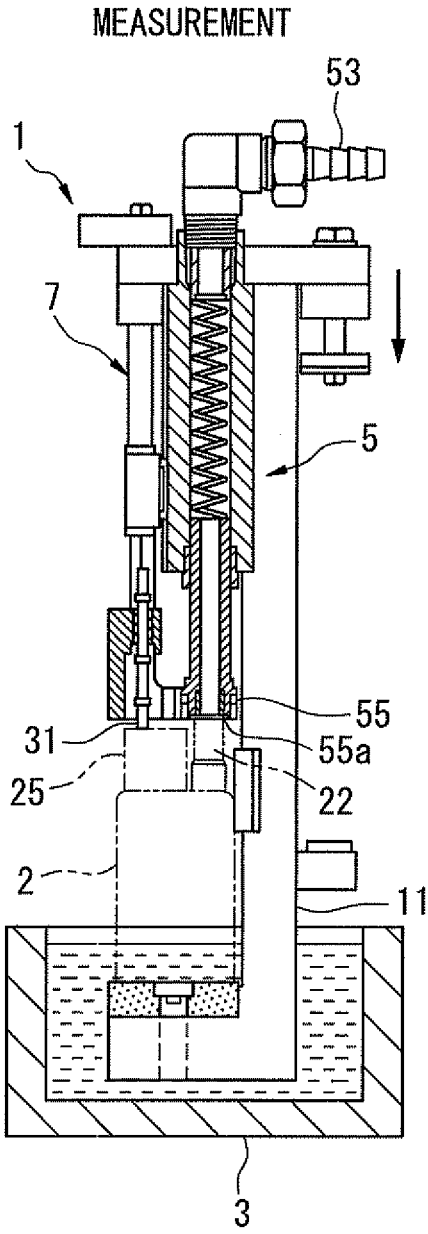
FIG. 9 is a side view of the test fixture for explaining a test procedure of a fuel pump which is attached to a test system of a fluid pump according to the present invention in a test process which uses the test system.

Next, at the step (4) which is shown in FIG. 9, the fuel pump 2 and the bottom part of the test fixture 1 are arranged to be immersed in the test oil tank 3, then measurement is started. If feeding power to the terminal 25 of the fuel pump 2 from the power supply 32 of FIG. 1 through the conducting probe 31, the drive unit 24 drives rotation of the pump 23 which then pumps up the test oil from the suction port 21 and discharges it from the discharge port 22 to the connecting pipe 5. The discharge rate changes depending on the rotational speed of the pump 23, so by adjusting the voltage which is applied to the drive unit 24 and the set pressure of the discharge pressure adjustment part 6 of the test flow path 4 which connects to the connecting pipe 5, it is possible to set a predetermined discharge pressure.

Therefore, in the test process of FIG. 4, first, at step 1, the drive unit 24 is supplied with a low voltage to drive the pump 23 by a low voltage. When the discharge pressure which is monitored by the pressure gauge 62 of the discharge pressure adjustment unit 6 becomes the condition of the vibration test, that is, 0.35 MPa, at the next step 2, vibration measurement is started. The vibration measurement is performed under conditions of a relatively low discharge pressure. By using a vibration sensor 42 which is attached to the fuel pump 2, performing measurements in the rotational direction and radial direction, analyzing the vibration waveform by FFT analysis, and comparing the results with normal parts, it is possible to distinguish abnormal parts.

Figure 10:
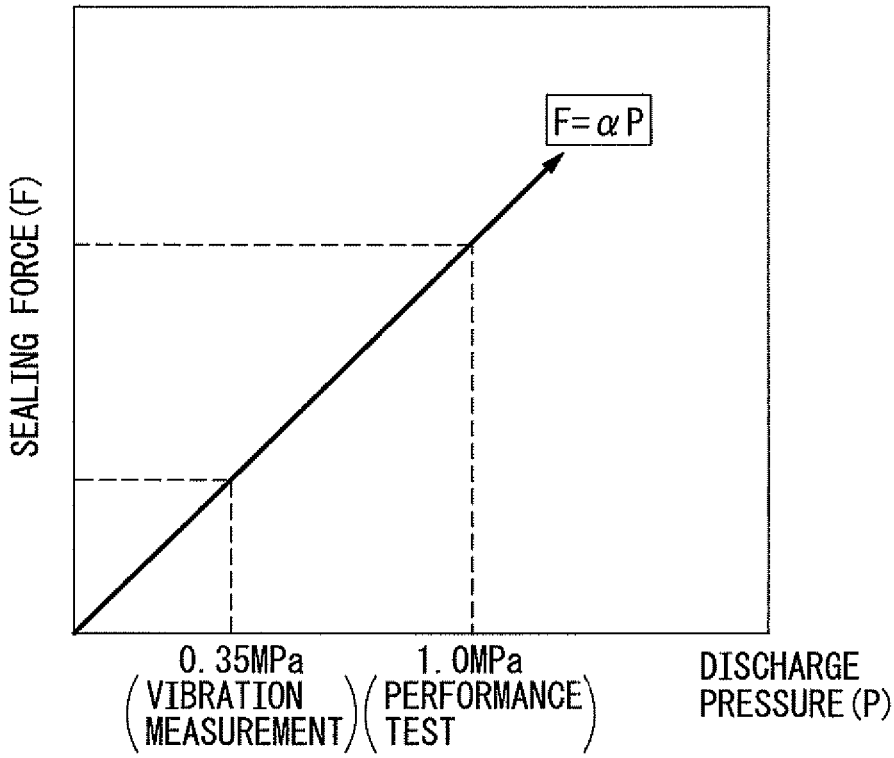
FIG. 10 is a view which shows a relationship between a discharge pressure and sealing force.

At the time of this vibration test, it is necessary to cause the fuel pump 2 to vibrate. The fuel pump 2 is attached to the test fixture 1 so that the clamp force becomes extremely small. In particular, to prevent the discharge port 22 of the fuel pump 2 from being pushed too much, it is sufficient that it be the minimum extent of clamp force for securing the sealing force with the connecting pipe 5. For this reason, in the present invention, a seal clamp 55 which has a self seal function is provided. Under low discharge pressure conditions, the force by which the test oil inside of the main pipe member 51 of the connecting pipe 5 pushes the movable pipe member 52 is also small. That is, as shown in FIG. 10, the sealing force F increases in proportion to the discharge pressure P, so it is possible to utilize this and enable good measurement with a suitable seal clamp force without obstructing a vibration test.

On the other hand, a flow rate test (performance test) is performed under greater discharge pressure conditions. For this reason, at step 3, the drive unit 24 is supplied with a high voltage and the pump 23 is driven at a high pressure so as to make the discharge pressure rise. When the discharge pressure becomes the condition of the performance test, that is, 1.0 MPa, at the next step 4, flow rate measurement is started. The flow rate measurement performs measurement using a flowmeter 41 which is provided at the test flow path 4 and judges if predetermined flow rate characteristics are obtained.

At the time of this performance test, the discharge pressure is relatively high, so it is necessary to reliably prevent oil leakage from the discharge port 22 of the fuel pump 2. Pushing by a larger seal clamp force is demanded. Here, the seal clamp 55 which is provided at the test fixture 1 of the present invention, as shown in FIG. 10, increases in sealing force F proportionally to the discharge pressure P, so increases the sale clamp force by the rise in its own discharge pressure. By utilizing this, good flow rate measurement is possible while preventing oil leakage by a suitable seal clamp force.

As explained above, according to the present invention, it is possible to perform a plurality of tests with different discharge pressure conditions by a series of process by the same test system. Furthermore, it is possible to use a test fixture which utilizes the discharge pressure to vary the seal clamp force and possible to satisfy the clamp conditions of the discharge port of the fuel pump, which differ between a vibration test and a performance test, so it is possible to realize high precision tests efficiently and at a low cost.

The present invention can be applied to a test system of various types of fluid pumps in addition to fuel pumps for use for vehicle internal combustion engines. Further, the invention is not limited to a vibration test or a flow rate test. If test processes with different discharge pressures or clamp conditions, a common measurement unit can be used and a plurality of tests can be continuously performed so as to obtain a similar effect of streamlining of the test process.

While the invention has been described by reference to specific embodiments chosen for purposes of illustration, it should be apparent that numerous modifications could be made thereto by those skilled in the art without departing from the basic concept and scope of the invention.

The invention claimed is:

1. A test system of a fluid pump which has a pump having a suction port and a discharge port of a fluid and a drive unit for driving the pump, comprising:

a test fixture which supports the fluid pump;

a fluid flow path which is provided with a discharge pressure adjusting means; and a connecting pipe arranged at the test fixture and having one end side connected to the discharge port of the pump and the other end side connected to the fluid flow path, wherein the connecting pipe comprises a main pipe member which includes said other end side, a movable pipe member arranged slidably inside the main pipe member and having an end which is positioned sticking out from the main pipe member and forms said one end side, and a seal clamp provided at said end of the movable pipe member, wherein when the movable pipe member receives fluid pressure inside of the main pipe member, the seal clamp which is pushed against the discharge port of the pump holds the discharge port of the pump liquid-tightly.

2. A test system of a fluid pump as set forth in claim 1, wherein the seal clamp comprises an elastic seal member which is interposed between the movable pipe member and the discharge port.

3. A test system of a fluid pump as set forth in claim 1, wherein the main pipe member has a pipe end which is connected to the fluid flow path, the flow diameter of the pipe end is smaller than the diameter of the space inside the main pipe member in which the movable pipe member can slide, and a spring member which biases the movable pipe member in the direction of the discharge port is arranged in the space inside of the main pipe member.

4. A test system of a fluid pump as set forth in claim 1, wherein the test fixture comprises a supporting base member which supports the connecting pipe and elastically supports the end of the fluid pump at the suction port side inside of a test fluid tank.

5. A test system of a fluid pump as set forth in claim 1, wherein the fluid pump comprises a terminal for feed of electric power to the drive unit and the test fixture comprises a conducting means for connecting the terminal to an external power supply.

6. A test system of a fluid pump as set forth in claim 5, wherein the test fixture comprises a holding member which holds the seal clamp and the conducting means to be able to advance and retract in the direction of connection to the discharge port and terminal.

7. A test method of a fluid pump which uses the test system as set forth in claim 1, wherein the test system further comprises a flow rate detecting means which is arranged in the fluid flow path which is provided with the discharge pressure adjusting means, the test method comprising:

a step of attaching a vibration detecting means to an outside wall of the fluid pump;

a first test process of using the discharge pressure adjusting means to adjust the first discharge pressure and using the vibration detecting means to run a vibration test of the fluid pump; and a second test process of using the discharge pressure adjusting means to adjust to a second discharge pressure which is higher than the first discharge pressure and using the flow rate detecting means to run a performance test of the fluid pump.

* * * * *